US005482823A

United States Patent [19]

Haga et al.

[11] Patent Number: 5,482,823

[45] Date of Patent: Jan. 9, 1996

[54] SILVER HALIDE PHOTOGRAPHIC EMULSION

[75] Inventors: Yoshihiro Haga; Tetsuya Suzuki; Yasuo Taima, all of Hino, Japan

[73] Assignee: Konica Corporation, Japan

[21] Appl. No.: 311,536

[22] Filed: Sep. 23, 1994

[30] Foreign Application Priority Data

Sep. 29, 1993 [JP] Japan ..... 5-243060
May 17, 1994 [JP] Japan ..... 6-102796

[51] Int. Cl.[6] ..... G03C 1/035; G03C 1/09

[52] U.S. Cl. ..... 430/567; 430/603

[58] Field of Search ..... 430/567, 603

[56] References Cited

U.S. PATENT DOCUMENTS 5,314,798 5/1994 Brust et al. ..... 430/567
5,320,938 6/1994 House et al. ..... 430/567

FOREIGN PATENT DOCUMENTS 96727 12/1983 European Pat. Off. ..... G03C 1/02
430625 6/1991 European Pat. Off. ..... G03C 1/035

*Primary Examiner*—Janet C. Baxter
*Attorney, Agent, or Firm*—Jordan B. Bierman; Bierman and Muserlian

[57] ABSTRACT

A silver halide photographic emulsion is provided, wherein the silver halide emulsion contains silver halide grains having an average iodide content of less than 3 mol %, the silver halide grains comprising monodispersed core/shell type silver halide grains containing internally high iodide, the core/shell grains having two parallel twin planes and a substantially roundish hexahedral or tetradecahedral form.

5 Claims, 1 Drawing Sheet

SILVER HALIDE PHOTOGRAPHIC EMULSION

FIELD OF THE INVENTION

This invention relates to a silver halide photographic emulsion, the process of the preparation thereof, a silver halide photographic light-sensitive material applied with the above-mentioned emulsion including, especially, a silver halide photographic light-sensitive material for medical use and the processing method thereof, and, particularly, to a silver halide photographic emulsion high in sensitivity and improved in aging preservation and development progress, the process of the preparation thereof, a silver halide photographic light-sensitive material applied with the above-mentioned emulsion including, especially, a silver halide photographic light-sensitive material for medical use and the processing method thereof.

BACKGROUND OF THE INVENTION

In recent years, there have been serious demands for silver halide photographic light-sensitive material (hereinafter sometimes referred simply to as a light-sensitive material) higher in sensitivity and image-quality higher and more stabilized in photographically aging characteristics, and various improvements of the techniques mainly of silver halide emulsions have been studied.

On the other hand, in the steps for developing a silver halide photographic light-sensitive material, a high-temperature and high-speed process has been rapidly popularized. Also when processing various kinds of silver halide photographic light-sensitive materials by making use of an automatic processor, the processing time has been shortened. For achieving a rapid processing, it has been demanded to obtain a satisfactory sensitivity and contrast gradation within a short time.

About the improvements in the color reproducibility of a silver halide color photographic light-sensitive material, Japanese Patent Publication Open to Public Inspection (hereinafter referred to as JP OPI Publication) No. 3-168734/1991 describes a monodisperse type silver halide twinned crystal emulsion having a ratio of a grain-size/a grain-thickness of less than 5, wherein, however, any roundish grain configuration after the grain is grown up is not described at all.

JP Examined Publication No. 4-33019/1992 describes a normal crystal emulsion in which silver iodide is localized inside thereof and the grains thereof are made roundish in configuration, wherein, however, a pressure-resistance improvement is mainly described, but any aging preservability (including, for example, any preservability under the conditions of a high humidity) is not described at all. Therefore, any more excellent technique has been demanded to be developed, because the above-mentioned conventional techniques have had a limit to make both aging preservability and development progress compatible, and have not been satisfactory to obtain the stability and rapid processability of the photographic characteristics which have been demanded to the recent light-sensitive materials.

SUMMARY OF THE INVENTION

Taking the above-mentioned problems into consideration, it is, accordingly, an object of the invention to provide a silver halide photographic emulsion high in sensitivity and improved in aging preservability and developability, the process of the preparation thereof, a silver halide photographic light-sensitive material applied with the above-mentioned emulsion, and, particularly to provide a silver halide photographic light-sensitive material for medical use and the method of processing the light-sensitive material therefor.

The above-mentioned object of the invention can be achieved with the following constitution.

A silver halide photographic emulsion comprises silver halide grains having an average iodide content (a proportion of iodide to the whole halide of the silver halide grains) of less than 3 mol %, the silver halide grains comprising monodisperse, and core/shell type silver halide grains having each two twin planes parallel to each other and having a substantially roundish, hexahedral or tetradecahedral form.

Figure 1:
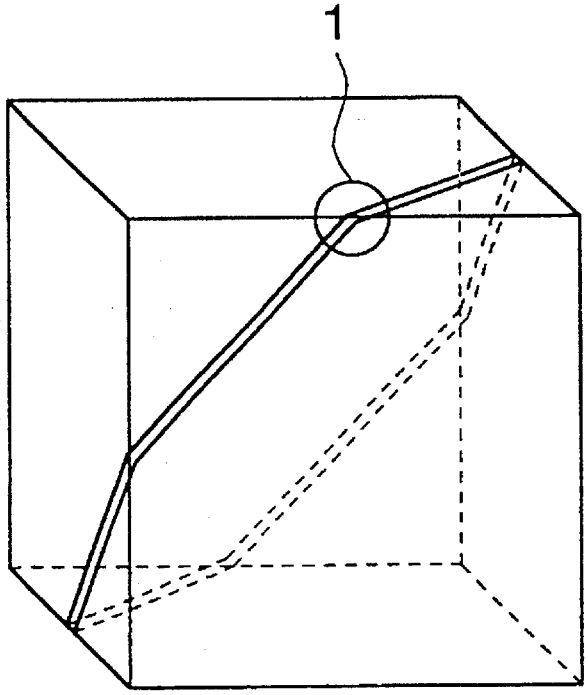
FIG. 1 is a perspective view illustrating a hexahedral twinned crystal grain as an example of the invention.

wherein 1 is a portion of a twin plane exposed to the surface of a crystal; and

2 is a trough.

DETAILED DESCRIPTION OF THE INVENTION

To a silver halide photographic emulsion of the invention, it is allowed to apply any silver halide such as silver bromide, silver iodobromide, silver iodochloride, silver chlorobromide, silver chloroiodobromide and silver chloride, which are also applicable to any ordinary silver halide emulsion. Among them, silver bromide, silver iodobromide and silver chloroiodobromide are preferred. Silver iodobromide is more preferable.

A silver halide grain of the invention is a monodisperse core/shell type silver halide grain comprising two twin planes parallel to each other and having a substantially roundish hexahedral or tetradecahedral-form.

In the invention, the silver halide grains having two twin planes parallel to each other account for not less than 50%, preferably not less than 60% and particularly not less than 70% of total grains by number.

Such a twin plane can be observed through a transmission type electron microscope. A concrete observation method is as follows. First, a sample is prepared by coating a silver halide photographic emulsion so that the silver halide grains of the emulsion can be oriented on a support of the sample. The resulting sample is sliced into a thin cut-piece having a thickness of the order of 0.1 μm. When the resulting cut-piece is observed through a transmission type electron microscope, the presence of the twin plane can be confirmed.

As for the process of preparing a silver halide emulsion of the invention comprising grains having two twin planes parallel to each other, a method of depositing silver halide on a seed crystal may preferably be used.

In a process of preparing a silver halide photographic emulsion by supplying a water-soluble silver salt solution and a water-soluble halide solution in the presence of a protective colloid, that is, in a process for preparing a silver halide emulsion of the invention comprising silver halide grains having two twin planes parallel to each other, the following process may preferably be used, comprising steps of a) forming silver halide nuclear grains containing 0 to 5 mol % iodide in a mother liquor, the pBr of the mother liquor being kept with a range of 2.5 to −0.7 for at least the initial half of the time necessary to form the nuclear grains;

(b) Following the above-mentioned nuclear grain forming step, forming substantially monodispersed spherical silver halide twinned crystal seed grains by ripening in the mother liquor containing a silver halide solvent of $10^{-5}$ to 2.0 mols per mol of silver halide or by repening in the mother liquor having an increased temperature of 40° to 80° C.; and then (c) increasing the size of the seed grains (or a grain formation step) by adding a water-soluble silver salt solution, a water-soluble halide solution and/or a silver halide fine grain.

The word, "a mother liquor", herein means a liquid (also including a silver halide emulsion) Supplied to the sites of preparing a silver halide emulsion from the beginning of the preparation up to the completion of a photographic emulsion.

Silver halide grains formed in the above-mentioned grain nucleus forming step are twinned crystal grains containing iodide within the range of 0 to 5 mol %.

The term, a "twinned crystal", herein means a silver halide crystal having one or more twin planes in one grain. The classification of the twinned crystal configurations are detailed in Klein & Moiser, "Photographisch Korrespondenz", Vol. 99, p. 99, and ibid., Vol. 100, p. 57.

Figure 2:
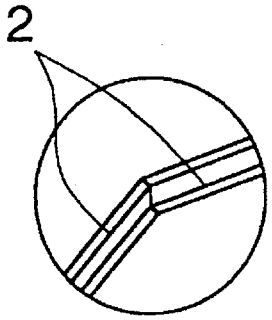
FIG. 2 is an enlarged illustration of reference numeral 1 shown in FIG. 1 of the invention.

In the invention, a "hexahedral-form" or a "tetradecahedral-form" has such a crystal form as a hexahedron or tetradecahedron each having two parallel twin planes, though it seems to have the same appearance as that of a normal crystal. FIG. 1 shows a typical example of the cases of the hexahedrons. FIG. 1 is a perspective view of a hexahedral twinned crystal grain of the invention, wherein referential numeral 1 is a portion where a twinned crystal is exposed to the crystal surface. FIG. 2 is an enlarged view of the portion of numeral 1 of FIG. 1, wherein numeral 2 shows a dented portion of the twin plane with a trough.

The above-mentioned grains will be hereinafter referred to as hexahedral or tetradecahedral twinned crystal grains.

In the invention, a "substantially roundish, hexahedral or tetradecahedral crystal" herein means that, supposing that polygons such as a triangle, a tetragon, a hexagon, and a octagon which are each formed by extending the sides constituting the outer surfaces of a hexahedral or tetradecahedral crystal, a radius of curvature of the roundness at the corners of a polygon having the largest area is within the range of r/10 to r/2 with respect to the angle at the corner, in which r represents a length of the longest side in the polygon having the largest area.

The roundness of a grain can be determined by observing a subject silver halide grain through an electron microscope.

In the invention, a silver halide emulsion is of the monodisperse type.

With the above-mentioned monodisperse type silver halide emulsion, a weight of the silver halide grains within the grain-size range of ±20% of an average grain-size d is preferably not less than 60% of the weight of the whole silver halide grain, more preferably not less than 70% thereof and, particularly not less than 80% thereof.

In the invention, a preferable monodisperse type emulsion has a grain-size distribution width of not more than 20% and, preferably not more than 15%, when the distribution width is defined by the following formula;

$$(\text{Standard deviation}/\text{Average grain-size})\times 100=\text{Distribution width}\ (\%)$$

wherein average grain-size d is defined by a grain-size di when a product of $ni\times di^3$ is maximized, wherein ni represents a frequency of a grain having a grain-size di. (a significant figure is of the three columns and a figure in the minimum column is rounded.)

The term, a "grain-size" herein stated means a diameter of a circular image having the same area as that of the projected image of a subject grain, and a diameter when a subject grain is of the spherical-shaped.

A grain-size can be obtained in the following manner, for example. A subject grain is magnified 10,000 to 70,000 times by an electron microscope and is then photographed thereby, and the diameter of the grain appeared on a print or the projected area of the grain is actually measured, (provided that the numbers of the grains subject to the measurement is to be not less than 1,000 at random.)

An average grain-size and a standard deviation are to be obtained from a grain-size di defined as above.

$$\text{An average grain-size}=(\Sigma dini/\Sigma ni)$$

When making use of silver iodobromide in the invention, the iodide content thereof is less than 3 mol %, preferably not more than 2.5 mol % and, particularly not more than 2 mol %, in terms of an average iodide content of the whole silver halide grain.

In silver halide grains applicable to the invention, an average iodine content of the uppermost surface layer of the grains is not more than 10 mol % and, preferably not more than 7 mol %.

A monodisperse core/shell type silver halide grain applicable to the invention is comprised of a silver halide grain having a structure of the grain comprising two or more layers each having the different iodide contents, that is, a grain comprised of a core (or an internal layer) and a shell covering the core. The shell is comprised of one or more layers. The iodide contents of the core and shell are preferable to be different from each other and, it is particularly preferable that the grain comprises a core having a maximum iodide content.

An iodide content of the above-mentioned core is preferable to be within the range of not less than 2.5 mol % to not more than the solid-solubility limit and, more preferable to be within the range of not less than 5 mol % to not more than the solid-solubility limit. Among the shells, the outermost shell, that is, a shell ordinarily forming the outermost surface layer, has an iodide content of, preferably, not more than 5 mol % and, more preferably, within the range of 0 to 2 mol %. The proportion of a core is to be within the range of, preferably, 2 to 60% of the whole volume of the subject grain and, more preferably 5 to 50% thereof.

An iodide distribution of a core is usually uniform, but it may sometimes have a distribution. For example, it is allowed that a silver iodide concentration may be made higher from the center of a grain toward the outside of the grain, or that an intermediate region may also have the maximum or minimum concentration thereof.

In a silver halide grain relating to the invention, the conditions of a silver iodide distribution may be detected in various physical measurement methods including, for example, a measurement of a low-temperature luminescence and an X-ray diffractometry, as described in Society of Photographic Science of Japan, 1981 Annual Convention, "The Summary of the Lectures".

About the X-ray diffractometry, it may be referred to "The Course of Basic Analytical Chemistry, No. 24, X-ray Diffractometry", (Kyoritsu Publishing Co.)

As a standard measurement method of the above-mentioned X-ray diffractometry, there is such a method that Cu and Kα rays of Cu are used as a target and an radiation source, respectively, and that a diffraction curve of the (420) plane of silver halide is obtained in a powder method by making use of, for example, a tube voltage of 40 kv and a tube current of 100 mv. Generally, the resolving power of a measurement instrument may be enhanced by suitably selecting a slit-width and a scanning type recording-speed and then by setting the step angle of a goniometer to be 0.02 degrees, so that a diffraction angles may be corrected by inserting a reference sample such as silicon into the goniometer.

In the invention, a relative standard deviation value (coefficient of variation) of the iodide content of grains is preferably not more than 20% and, more preferably not more than 15%.

In the invention, an iodide content and an average iodide content of each of individual grains can be obtained by making use of an EPMA (Electron Probe Micro Analyzer) method. In this method, a well-dispersed sample is so prepared as not to bring emulsion grains into contact with each other and a very minute portion of an element can be analyzed by an X-ray analysis carried out by exciting and irradiating an electron beam.

In the above-mentioned method, the halide composition of individual grains can be determined by obtaining the characteristic X-ray intensity of silver and iodide radiated from individual grains. When obtaining an iodide content of at least 50 grains in an EPMA method, an average iodide content can be obtained from an average of the iodine contents of 50 grains.

With a silver halide grain relating to the invention, an iodide content of the outermost surface layer thereof is to be regarded as an iodide content of a portion in a depth of about 50 Å from the surface, which can be determined by means of XPS (X-ray Photoelectron Spectroscopy) analysis of a silver halide grain cooled below −110° C.

A monodisperse core/shell type silver halide grain of the invention is preferable to be that obtained by making present in advance an aqueous solution containing a protective colloid and seed grains in a reactor vessel and silver ion, halogen ion or silver halide fine grain is supplied thereto to grow the seed grains.

In the above-mentioned case, it is allowed that the centeral portion of the grain may have a different halide composition region from that of the core of the grain. The seed grain may have any halide compositions, that is, any one of silver bromide, silver iodide, silver chloride, silver iodobromide, silver chlorobromide, silver chloroiodide and silver chloroiodobromide may be used in the seed grain. Among them, silver bromide and silver iodobromide are preferred.

As disclosed in JP OPI Publication Nos. 51-39027/1976, 55-142329/1980, 58-113928/1983, 54-48521/1979 and 58-49938/1983, the requirements for increasing the size of the prepared seed grains so as to obtain a monodisperse core/shell type silver halide grain of the invention, such requirements include, for example, such a method that a water-soluble silver salt solution and a water-soluble halide solution are added together in a double-jet method, and the adding speed thereof is gradually varied, provided that any new nucleus formation cannot be produced as the grain is being swelled and that any Ostwald ripening cannot also be produced. As disclosed in Society of Photographic Science of Japan, 1983 Annual Meeting, "The summary of Lectures", Article 88, it is also allowed to use a method in which a silver halide fine grain is added, dissolved and then recrystallized, so that the seed grain can be swelled.

When growing the grains, it is preferable to add an aqueous silver nitrate solution and an aqueous halide solution in a double-jet method or a triple-jet method. It is also allowed to supply iodide in the form of silver iodide to the system. The adding rate thereof is to be such a rate as neither to produce any new nucleus nor to widen any size-distribution that may be produced by an Ostwald ripening, that is to say, it is preferable to add the solutions at an adding rate within the range of 30 to 100% of a rate at which a new nucleus may be produced.

In the preparation of a silver halide photographic emulsion of the invention, when silver iodide is supplied as a source of iodide, not less than 50 mol %, preferably not less than 70% and, particularly not less than 100% of the total iodide amount to be supplied is accounted for by silver iodide fine grains.

As silver iodide, a cubic crystal system γ-AgI and a hexahedral crystal system β-AgI have generally been known. However, as fine-grained silver iodide when it is used in the invention, ether one of the crystal systems or the mixture thereof may be used. The grain-size of the silver iodide fine grains is preferable to have an average grain-size of not larger than 0.1 μm.

In the preparation of a silver halide photographic emulsion of the invention, halide ion and silver ion may be mixed up together at the same time, or one of them may also be mixed in the presence of the other. Taking the critical growth rate of a silver halide crystal into consideration, halide ion and silver ion may be added one after another or at the same time whole controlling the pAg and pH inside a mixing chamber, and then the silver halide crystal may be grown up. Also, in any steps of forming silver halide, the silver halide compositions of a grain may also be varied by a halide conversion method. Further, halide ion and silver ion may be supplied in the form of a silver halide fine grain, to the mixer vessel.

In the preparation of a silver halide photographic emulsion of the invention, it is allowed to make present a well-known silver halide solvents including, for example, ammonia, thioether, thiourea and thiocyanate as given in JP OPI Publication No. 3-168734/1991.

In the preparation of a silver halide photographic emulsion of the invention and in the step of forming a silver halide grain, after adding at least 70% of water-soluble silver salt to form the grains of a silver halide emulsion, a pAg is increased by 1 or more and, preferably 1.5 or more, as compared to a pAg before adding at least 70% of the water-soluble silver salt, thereby the grains are made substantially roundish as defined.

In the emulsion prepared as mentioned above, a suitable amount of a silver halide solvent may be added to the emulsion at any point of time from the time when a silver halide grain is formed to the time when a chemical ripening treatment is started, and that they are then mixed up uniformly so as to make the grain substantially roundish.

After forming a silver halide emulsion, it is further allowed to desalt (and, to wash) the silver halide emulsion before the emulsion is treated with a solvent.

A silver halide photographic emulsion of the invention may be prepared by any one of an acidic method, a neutral method and an ammoniacal method. However, it is preferable that the pH of the emulsion in the step of forming silver halide grains is to be not higher than 7.0.

To a silver halide grain that is to be contained in a silver halide photographic emulsion of the invention, a metal ion is added by making use of a cadmium salt, a zinc salt, a lead salt, a thallium salt, an iridium salt (including the complex salts thereof), a rhodium salt (including the complex salts thereof) and an iron salt (including the complex salts thereof) in the courses of forming nuclei and/or growing thereof, so that these metal elements may be contained inside the grain and/or on the grain surface. It is also allowed that a reduction-sensitization nucleus can be provided to the inside of the grain and/or to the grain surface, under a suitable reducing condition.

It is preferable that the reducing agent added at any point of time of forming a grain may be deactivated by adding an oxidizing agent such as hydrogen peroxide (water) and the adducts thereof, a peroxo acid salt, ozone and $I_2$ at any point of time, so that the reducing agent may be inhibited or stopped in reduction.

The point of time when adding an oxidizing agent may be freely selected, provided, it is from the time when forming a silver halide grain to the time before adding a gold-sensitizer (or a chemical sensitizer if no gold-sensitizer is used) in a chemical sensitization step.

In the invention, gelatin is preferably used as a dispersion medium for a protective colloid applicable to a silver halide grain. Gelatin applicable thereto include, for example, an alkali-treated gelatin, an acid-treated gelatin, a low molecular weight gelatin (having a molecular weight within the range of 20,000 to 100,000) and a modified gelatin such as phthalated gelatin. Other hydrophilic colloids than the above may also be applicable. The concrete examples thereof are given in Research Disclosure (hereinafter abbreviated to as RD), Vol. 176, No. 17643, (December, 1978), Paragraph IX.

When growing a silver halide grain, any needless soluble-salts may be removed from a silver halide emulsion of the invention, or may also be contained therein as it is. When removing the salt, it may be removed in accordance with the method described in RD, Vol. 176, No. 17643, Paragraph II.

In the preparation of a silver halide photographic emulsion of the invention, the optimum conditions other than the above can be selected with reference to the well-known methods given in JP OPI Publication Nos. 61-6643/1986, 61-14630/1986, 61-112142/1986, 62-157024/1987, 62-18556/1987, 63-92942/1988, 63-151618/1988, 63-163451/1988, 63-220238/1988 and 63-311244/1988.

In the invention, a silver halide photographic emulsion can be chemically sensitized. There is no special limitation to a chemical ripening treatment that includes, concretely, the requirements for a chemical sensitization step, such as a pH, a pAg, a temperature and a time. Therefore, a chemical ripening treatment can be performed under the conditions generally accepted in the field of the art. For carrying out a chemical sensitization, the following chemical sensitization processes can be used independently or in combination; namely, a sulfur sensitization in which a compound containing sulfur capable of reacting with silver ion or an active gelatin is used; a selenium sensitization in which a selenium compound is used; a tellurium sensitization in which a tellurium compound is used; a reduction sensitization in which a reducing substance is used; a noble metal sensitization in which a noble a metal such as gold is used. Among these chemical sensitization processes, a selenium sensitization, a tellurium sensitization and a reduction sensitization may preferably be used.

In the case of a selenium sensitization, selenium sensitizers applicable thereto includes a wide range of selenium compounds. With respect to this, there are disclosed in, for example, U.S. Pat. Nos. 1,574,944, 1,602,592 and 1,623,499 and JP OPI Publication Nos. 60-150046/1985, 4-25832/1992, 4-109240/1992 and 4-147250/1992.

The useful selenium sensitizers include, for example, a colloidal selenium metal, an isoselenocyanate (such as allyl isoseleno cyanate), a seleno urea (such as N,N-dimethyl seleno urea, N,N,N'-triethyl seleno urea, N,N,N'-trimethyl-N'-heptafluoro seleno urea, N,N,N'-trimethyl-N'-heptafluoro propyl carbonyl seleno urea and N,N,N'-trimethyl-N'-4-nitrophenyl carbonyl seleno urea), a seleno ketone (such as seleno acetone and seleno acetophenone), a seleno amide (such as seleno acetamide and N,N-dimethyl seleno benzamide), a seleno carboxylic acid and a seleno ester (such as 2-seleno propionic acid and methyl-3-seleno butyrate), a seleno phosphate (such as tri-p-triseleno phosphate), and a selenide (such as diethyl selenide, diethyl diselenide and triphenyl phosphine selenide). Among them the particularly preferable selenium sensitizers include, for example, a seleno urea, a seleno amide, a selenide and a seleno ketone.

The concrete examples of the techniques of making use of the above-given selenium sensitizers are disclosed in the following patents; namely, U.S. Pat. Nos. 1,574,944, 1,602,592, 1,623,499, 3,297,446, 3,297,447, 3,320,069, 3,408,196, 3,408,197, 3,442,653, 3,420,670 and 3,591,385, French Patent Nos. 2693038 and 2093209, JP Examined Publication Nos. 52-34491/1977, 52-34492/1977, 53-295/1978 and 57-22090/1982, JP OPI Publication Nos. 59-180536/1984, 59-185330/1984, 59-181337/1984, 59-187338/1984, 59-192241/1984, 60-150046/1985, 60-151637/1985, 61-246738/1986, 3-4221/1991, 3-24537/1991, 3-111838/1991, 3-116132/1991, 3-148648/1991, 3-237450/1991, 4-16838/1992, 4-25832/1992, 4-32831/1992, 4-96059/1992, 4-109240/1992, 4-140738/1992, 4-140739/1992, 4-147250/1992, 4-149437/1992, 4- 184331/1992, 4-190225/1992, 4-191729/1992 and 4-195035/1992, and British Patent Nos. 255846 and 861984. Besides the above, the techniques are also disclosed in, for example, H. E. Spencer et al, "Journal of Photographic Science" Vol. 31, pp. 158–169, (1983), and other literatures on science.

An amount of a selenium sensitizer to be used is varied by a selenium compound and a silver halide grain each used therein, a chemical ripening conditions applied thereto, and so forth. However, a selenium sensitizer is generally used in an amount of the order of $10^{-8}$ to $10^{-4}$ mols per mol of silver halide.

The methods for adding a selenium sensitizer may include, for example, a method in which it is dissolved in water or an independent or mixed organic solvent such as methanol and ethanol so as to meet the characteristics of a selenium compound to be used and then added; another method in which a selenium sensitizer is mixed with a gelatin solution in advance and then added; and a further method disclosed in JP OPI Publication No. 4-140739/1992 in which a sensitizer is added in the form of the emulsified dispersion of a solution mixed with an organic solvent-soluble polymer.

A temperature in the course of carrying out a chemical ripening treatment is to be within the range of, preferably, 40° to 90° C. and, more preferably, not lower than 45° C. to not higher than 80° C. A pH and a pAg therein are preferred to be within the ranges of 4 to 9 and 6 to 9.5, respectively.

A tellurium sensitizer and the sensitization process thereof are disclosed in U.S. Pat. Nos. 1,623,499, 3,320,069, 3,772,031, 3,531,289 and 3,655,394, British Patent Nos. 235,211, 1,121,496, 1,295,462 and 1,396,696, Canadian Patent No. 800,958, and JP OPI Publication No. 4-204640/1992. The examples of the useful tellurium sensitizers include a telluro urea (such as N,N-dimethyl telluro urea, tetramethyl telluro urea, N-carboxyethyl-N,N'-dimethyl telluro urea and N,N'-dimethyl-N'-phenyl telluro urea), a phosphine telluride (such as tributyl phosphine telluride, tricyclohexyl phosphine telluride, triisopropyl phosphine telluride, butyl-diisopropyl phosphine telluride and dibutyl phenyl phosphine telluride), a telluro amide (such as telluro acetoamide and N,N-dimethyl telluro benzamide), a telluro ketone, a telluro ester and an isotelluro cyanate.

A technique of making use of the above-given tellurium sensitizers is in accordance with the case of the aforementioned techniques of making use of the selenium sensitizers.

It is also preferable that the so-called reduction sensitization is carried out by exposing grains to a suitable reducible atmosphere, a reduction sensitization nucleus may be provided to the inside of the grain and/or the surface thereof.

The preferable examples of a reducing agent include thiourea dioxide, and ascorbic acid and the derivatives thereof. The other preferable reducing agents include, for example, a polyamine such as hydrazine and diethylene triamine, a dimethyl amine borane and a sulfite.

It is preferable to vary an amount of a reducing agent added so as to meet a kind of the reduction sensitizer used, a grain-size, composition and crystal habit of the silver halide grains used, a temperature of the reaction system used, an environmental condition such as a pH and a pAg, and so forth. In the case of thiourea dioxide, for example, a favorable result may be enjoyed, when adding a reducing agent in an amount within the range of about 0.01 to 2 mg per mol of silver halide used, as a rough standard. In the case of ascorbic acid, it is preferable to add a reducing agent in an amount within the range of about 50 mg to 2 g per mol of silver halide used.

The preferable conditions for carrying out a reduction sensitization are as follows; a temperature is to be within the range of about 40° to 70° C., a time is to be about 10 to 20 minutes, a pH is about 5 to 11 and a pAg is about 1 to 10, respectively, (provided, a pAg value is a reciprocal of a concentration of Ag+ion).

As for a water-soluble silver salt, silver nitrate is preferred. The so-called silver ripening treatment, that is one kind of a reduction sensitization technique, may be carried out by adding a water-soluble silver salt. In carrying out a silver ripening treatment, a pAg is to be within the range of, suitably 1 to 6 and, preferably 2 to 4. The conditions of a temperature, pH, time and so forth are preferable to be within the range of the above-mentioned conditions for a reduction sensitization.

As for the stabilizers applicable to a silver halide photographic emulsion containing a reduction-sensitized silver halide grain, any common stabilizers (about which will be detailed later) may be used. When making combination use of an antioxidant disclosed in JP OPI Publication No. 57-82831/1982 and/or a thiosulfonic acid detailed in VS.. Gahler, "Zeitshrift fur wissenschaftliche Photographie" Bd. 63, 133, (1969) and JP OPI Publication No. 54-1019/1979, at that time, an excellent result may often be obtained. These compounds may be added at any points in the course of an emulsion preparation from a crystal growth to a emulsion preparation step immediately before coating.

In the invention, a selenium sensitization, a tellurium sensitization, a reduction sensitization and so forth may be carried out in combination. Besides, it is preferred to make combination use of the above-mentioned sensitization with other sensitization processes including, for example, a noble-metal sensitization.

A sulfur sensitizers applicable to the invention include, for example, those described in U.S. Pat. Nos. 1,574,944, 2,410,689, 2,278,947, 2,728,668, 3,501,313 and 3,656,955, West German Patent (OLS) No. 1,422,869, and JP OPI Publication Nos. 56-24937/1981 and 55-45016/1980. The concrete examples thereof include, preferably, a thiourea derivative such as 1,3-diphenyl thiourea, triethyl thiourea, 1-ethyl-3-(2-thiazolyl)thiourea, a rhodanine derivative, a dithiacarbamic acid, a polysulfide organic compound and a simple substance of sulfur. As for the simple substance of sulfur, α-sulfur belonging to a rhombic system is preferred.

A gold sensitizer include, for example, chloroauric acid, gold thiosulfate, sold thiocyanate and, besides, a thiourea, a rhodanine and other gold complexes of various compounds.

An amount of a sulfur sensitizer or a gold sensitizer to be used may be varied according to a silver halide emulsion, a compound to be used and the ripening conditions to be applied. However, they are ordinarily used in an amount within the range of, preferably $1\times10^{-4}$ to $1\times10^{-9}$ mols per mol of silver halide used and, more preferably $1\times10^{-5}$ to $1\times10^{-8}$ mols.

In the invention, a sulfur sensitizer and a gold sensitizer may be added in such a manner that they are dissolved in water, an alcohol, or other organic or inorganic solvent and then they may be added in the form of a solution, or that they are added in the form of a dispersion obtained by emulsifying and dispersing them upon utilizing water and a insoluble solvent or a medium such as gelatin.

In the invention, a sulfur sensitization and a gold sensitization may also be carried out at the same time, or the two sensitizations may also be separately carried out stepwise. In the latter case, a favorable result may sometimes be obtained when a gold sensitization is carried out after suitably carrying out a sulfur sensitization or in the course thereof.

A silver halide photographic light-sensitive material of the invention is processed in the following manner. a silver halide photographic light-sensitive material containing a silver halide photographic emulsion of the invention is processed in the processing steps including a processing bath not containing any layer hardener, for the whole processing time within the period of 15 seconds to 90 seconds.

A silver halide photographic emulsion relating to the invention may be added with a variety of photographic additives in the steps before or after carrying out a physical or chemical ripening treatment. The well-known additives include, for example, the compounds given in Research Disclosure No. 17643, (December, 1978), ibid., No. 18716 (November, 1979) and ibid., No. 308119 (December, 1989). The compounds given in the above-mentioned three Research Disclosures and the pages on which the additives appear will be shown below.

| | RD-17643 | | RD-18716 | | RD-308119 | |
|---|---|---|---|---|---|---|
| Additive | Page | Class | Page | Class | Page | Class |
| Chemical sensitizer | 23 | III | 648 | u.r. | 996 | III |
| Sensitizing dye | 23 | IV | 648–649 | | 996–8 | IV |
| Desensitizing dye | 23 | IV | | | 998 | IV |
| Dyestuff | 25–26 | VIII | 649–650 | | 1003 | VIII |
| Development accelerator | 29 | XXI | 648 | u.r. | | |

-continued

| Additive | RD-17643 Page | RD-17643 Class | RD-18716 Page | RD-18716 Class | RD-308119 Page | RD-308119 Class |
|---|---|---|---|---|---|---|
| Antifoggant · stabilizer | 24 | IV | 649 | u.r | 1006–7 | VI |
| Whitening agent | 24 | V | | | 998 | V |
| Layer hardener | 26 | X | 651 | l. | 1004–5 | X |
| Surfactant | 26–7 | XI | 650 | r. | 1005–6 | XI |
| Antistatic agent | 27 | XII | 650 | r. | 1006–7 | XIII |
| Plasticizer | 27 | XII | 650 | r. | 1006 | XII |
| Lubricant | 27 | XII | | | | |
| Matting agent | 28 | XVI | 650 | r. | 1008–9 | XVI |
| Binder | 26 | XXII | | | 1003–4 | IX |
| Support | 28 | XVII | | | 1009 | XVII |

A support applicable to a light-sensitive material relating to the invention include, for example, those given in the foregoing RD-17643, p. 28 and RD-308119, p. 1009.

A suitable support include that made of plastic film. It is also allowed to apply a sublayer, a corona-discharge, a UV irradiation and so forth, so that the surface of such a support as mentioned above may readily be made adhered to a coated layer.

EXAMPLES

Now, the invention will be detailed with reference to the following examples. However, the invention shall not be limited thereto.

Example 1

(Preparation of spherical-shaped twinned crystal seed emulsion)

By making use of the following solutions, seed emulsion A was prepared.

| | |
|---|---|
| Solution A1 | |
| Ossein gelatin | 40 g |
| Potassium bromide | 75.1 g |
| $HO(CH_2CH_2O)_m—(CH(CH_3)CH_2O)_{17}—(CH_2CH_2O)_nH$ (m + n ≈ 5.7, a molecular weight = 1700), (a 10% methanol solution) | 10 ml |
| Add water to make | 4000 ml |
| Solution B1 | |
| Silver nitrate | 600 g |
| Add water to make | 803 ml |
| Solution C1 | |
| Ossein gelatin | 16.1 g |
| Potassium bromide | 411.7 g |
| Potassium iodide | 11.7 g |
| Add water to make | 803 ml |
| Solution D1 | |
| Aqueous ammonia (in a 28% solution) | 235 ml |

Solutions B1 and C1 were added to Solution A1, while violently stirring, by a double-jet method at a flow rate of 62.8 ml/min. The addition thereof was carried out in such a manner that the flow rate was gradually accelerated from the point of time of 4 minutes 46 seconds after starting the addition so that the final flow rate could be 105 ml/min. The total addition time was 10 minutes 45 seconds. In the course of the addition, the pBr thereof was kept at 1.3 by making use of a (3.5N) potassium bromide solution.

After completing the addition, the temperature of the resulting mixed solution was linearly cooled down to 20° C. by taking 10 minutes and Solution D1 was added thereto by taking 20 seconds. Thereafter, a ripening treatment was carried out for 5 minutes. The pBr concentration in the ripening treatment and the ammonia concentration were 0.07 mols/liter and 0.63 mols/liter, respectively.

After completing the ripening treatment, the pH was adjusted to be 6.0 and a desalting treatment and a washing treatment were then carried out. When observing the resulting seed emulsion grains through an electron microscope, they were proved to be monodisperse type spherical-shaped emulsion grains having an average grain-size of 0.24 μm, two twin planes parallel to each other and a grain distribution width of 18%, (provided that the ratio of grains having the two parallel twin planes was 75% of the whole grain by number).

Preparation of Em-1

(Preparation of fine-grained silver iodide emulsion)

To 5000 ml of a 5.0 wt % gelatin solution containing 0.128 mols of potassium iodide, 1500 ml of an aqueous 5.24-mol silver nitrate solution and 1500 ml an aqueous 5.24-mol potassium iodide solution were added by taking 35 minutes. In the course of the addition, the temperature of the mixture was kept at 40° C. The average grain-size of the resulting silver iodide fine grains was proved to be 0.05 μm.

By making use of seed emulsion A and the following three kinds of solutions, a comparative, hexahedral, twinned crystal emulsion Em-1 was prepared.

| | |
|---|---|
| Solution A2 | |
| Ossein gelatin | 42.7 g |
| $HO(CH_2CH_2O)_m—(CH(CH_3)CH_2O)_{17}—(CH_2CH_2O)_nH$ (m + n ≈ 5.7, a molecular weight = 1700), (a 10% methanol solution) | 9 ml |
| An aqueous 28% ammonia solution | 370 ml |
| An aqueous 56% acetic acid solution | 530 ml |
| Seed emulsion A | Equivalent to 0.293 mols |
| Add water to make | 4200 ml |
| Solution B2 | |
| Ossein gelatin | 23.3 g |
| Potassium bromide | 2357 g |
| Add water to make | 4660 ml |
| Solution C2 | |
| Silver nitrate | 3510 g |
| An aqueous 28% ammonia solution | 2880 ml |
| Add water to make | 5940 ml |
| Solution D2 | |
| A fine-grained silver iodide emulsion | Equivalent to 0.215 mols |
| Solution E2 | |
| An aqueous 3.5 N potassium bromide solution | |
| Solution F2 | |
| An aqueous 56% acetic acid solution | |

Solutions B2, C2 and D2 were each added to Solution A2, while being violently stirred, by a double-jet method.

Wherein, the adding rates of Solutions B2 and C2 were varied functionwise to time so as to meet the critical growth rate and, the solutions were each added at a suitable adding rate so as not to produce any small-sized grains other than the seed crystals being grown, nor to produce any polydispersion due to an Ostwald ripening. In the supply of Solution D2, that is, in the addition of a fine-grained silver iodide emulsion, the adding rate thereof was varied to the grain-sizes in terms that the adding rate thereof was set to be 0.3 relative to the adding rate (or the mol ratio) to Solution C2, and the addition of Solution D2 was completed when 3% of the total amount of Solution C2 was added.

By making use of Solutions E2 and F2, the pAg and pH were kept to be 7.5 and 7 in all the courses of growing the grains from the beginning to the end.

After completing the addition, a coagulation desalting was carried out for removing an excess salts by making use of an aqueous solution of Demol (manufactured by Kao-Atlas Inc.) and an aqueous magnesium sulfate solution, and thereafter gelatin was added. A redispersion was then carried out, so that an emulsion having a pAg of 8.5 and a pH of 5.85 could be obtained at 40° C.

When observing the resulting emulsion through an electron microscope, it was proved to comprise monodisperse, hexahedral, twinned crystal and core/shell type silver halide grains having an average grain-size of 0.98 μm, a distribution width of 15% and an average iodide content of 1 mol %.

Preparation of Em-2

Emulsion Em-2 was prepared in the same preparation procedures as in the case of Em-1, provided that 1800 ml of an aqueous 4.37N potassium bromide solution was added at a constant flow rate by taking 8 minutes from the point of time 106 minutes after starting the addition of Solution C2 (or, from 76% of the total amount of Solution C2 added.) In the above-mentioned course, the pAg was varied from 7.5 into 9.92. Thus, Em-2 of the invention was prepared in the same manner as in Em-1, except that the aqueous potassium bromide solution was added.

When observing the resulting emulsion through an electron microscope, it was proved to comprise monodisperse, tetrahedral, twinned crystal and core/shell type silver halide grains having an average grain-size of 0.98 μm, a distribution width of 15%, an average iodide content of 1 mol % and a roundness (r/8).

Preparation of Em-3

Emulsion Em-3 was prepared in the same preparation procedures as in the case of Em-1, provided, 1800 ml of an aqueous 4.37N potassium bromide solution was added at a constant flow rate by taking 8 minutes, after starting the addition of Solution C2. In the above-mentioned course, the pAg was varied from 7.5 into 9.92. Thus, Em-3 of the invention was prepared in the same manner as in Em-1, except that the aqueous potassium bromide solution was added.

When observing the resulting emulsion through an electron microscope, it was proved to comprise monodisperse, twinned crystal and core/shell type silver halide grains having an average grain-size of 0.98 μm, a distribution width of 15%, an average iodide content of 1 mol % and a roundness (r/4).

Preparation of Em-4

Emulsion Em-4 of the invention was prepared in the same manner as in the case of Em-2, except that the supply of Solution D2, that is, the supply of a fine-grained silver iodide emulsion was made in such a manner that the supply rate thereof was varied to the grain-sizes in terms that the adding rate thereof was set to be 0.3 relative to the adding rate (or the mol ratio) to Solution C2, and that the addition of Solution D2 was completed when 8.4% of the total amount of Solution C2 was added.

When observing the resulting emulsion through an electron microscope, it was proved to comprise monodisperse, tetrahedral, twinned crystal and core/shell type silver halide grains having an average grain-size of 0.98 μm, a distribution width of 15%, an average iodide content of 0.25 mol % and a roundness (r/8).

Preparation of Em-5

Emulsion Em-5 of the comparison was prepared in the same manner as in the case of Em-2, except that the supply of Solution D2, that is, the supply of a fine-grained silver iodide emulsion, was made in such a manner that the supply rate thereof was varied to the grain-sizes in terms that the adding rate thereof was set to be 0.3 relative to the adding rate (or the mol ratio) to Solution C2, and that the addition of Solution D2 was completed when 11.8% of the total amount of Solution C2 was added.

When observing the resulting emulsion through an electron microscope, it was proved to comprise monodisperse, tetrahedral, twinned crystal and core/shell type silver halide grains having an average grain-size of 0.98 μm, a distribution width of 17%, an average iodine content of 3.5 mol % and a roundness (r/8).

Preparation of Em-6

By making use of seed solution A and the following three kinds of solutions, hexahedral, twinned crystal, comparative emulsion Em-6 was prepared.

| | |
|---|---|
| Solution A3 | |
| Ossein gelatin | 42.7 g |
| $HO(CH_2CH_2O)_m—(CH(CH_3)CH_2O)_{17}—(CH_2CH_2O)_nH$ ($m + n \approx 5.7$, a molecular weight = 1700), (a 10% methanol solution) | 9 ml |
| Seed emulsion A | Equivalent to 0.293 mols |
| Add water to make | 4200 ml |
| Solution B3 | |
| Ossein gelatin | 28.2 g |
| Potassium bromide | 2345 g |
| Add water to make | 5630 ml |
| Solution C3 | |
| Silver nitrate | 3510 g |
| Add water to make | 5940 ml |
| Solution D3 | |
| A fine-grained silver iodide emulsion | Equivalent to 0.215 mols |
| Solution E3 | |
| An aqueous 17.5 N potassium bromide solution | |

Solutions B3, C3 and D3 were each added to Solution A3, while being violently stirred at 75° C., by a double-jet method.

In the above, the adding rates of Solutions B3 and C3 were varied functionwise to time so as to meet the critical growth rate and, the solutions were each added at a suitable adding rate so as not to produce any small-sized grains other than the seed crystals being grown, nor to produce any polydispersion due to an Ostwald ripening. In the supply of Solution D3, that is, in the supply of a fine-grained silver iodide emulsion, the supply rate thereof was varied to the grain-sizes in terms that the adding rate thereof was set to be 0.3 relative to the adding rate (or the mol ratio) to Solution C3, and the addition of Solution D3 was completed when 8.4% of the total amount of Solution C2 was added.

By making use of Solution E3, the pAg was kept constantly to be 6.2 in all the courses of growing the grains from the beginning to the end.

After completing the addition, a coagulation desalting was carried out, for removing an excess salts, by making use of an aqueous solution of Demol (manufactured by Kao-Atlas Inc.) and an aqueous magnesium sulfate solution, and then gelatin was added. A redispersion was then carried out, so that an emulsion having a pAg of 8.5 and a pH of 5.85 could be obtained at 40° C.

When observing the resulting emulsion through an electron microscope, it was proved to comprise monodisperse, hexahedral, twinned crystal and core/shell type silver halide grains having an average grain-size of 0.98 μm, a distribution width of 14% and an average iodide content of 2.5 mol %.

Preparation of Em-7

Emulsion Em-7 was prepared in the same preparation procedures as in the case of Em-6, provided that 1650 ml of an aqueous 4.37N potassium bromide solution was added at a constant flow rate by taking 6 minutes from the point of time 180 minutes after starting the addition of Solution C3 (or, from 76% of the total amount of Solution C3 added.) In the above-mentioned course, the pAg was varied from 6.2 into 9.7. Em-7 of the invention was prepared in the same manner as in Em-6, except that the aqueous potassium bromide solution as above was added.

When observing the resulting emulsion through an electron microscope, it was proved to comprise monodisperse, tetrahedral, twinned crystal and core/shell type silver halide grains having an average grain-size of 0.98 μm, a distribution width of 14%, an average iodide content of 2.5 mol % and a roundness (r/8).

Preparation of Em-8

Emulsion of the invention Em-8 was prepared in the same manner as in Em-7, except that the supply of Solution D3, that is, the supply of a fine-grained silver iodide emulsion, was made in such a manner that the supply rate thereof was varied to the grain-sizes (or an adding time) in terms that the adding rate thereof was set to be 0.3 relative to the adding rate (or the mol ratio) to Solution C3, and that the addition of Solution D3 was completed when 3% of the total amount of Solution C3 was added.

When observing the resulting emulsion through an electron microscope, it was proved to comprise monodisperse, tetrahedral, twinned crystal and core/shell type silver halide grains having an average grain-size of 0.98 μm, a distribution range of 14%, an average iodine content of 1.0 mol % and a roundness (r/8).

Preparation of Em-9

Emulsion of the invention Em-9 was prepared in the same manner as in Em-8, except that the supply of Solution D3, that is, the supply of a fine-grained silver iodide emulsion, was made in such a manner that the supply rate thereof was varied to the grain-sizes (or an adding time) in terms that the adding rate thereof was set to be 0.06 relative to the adding rate (or the mol ratio) to Solution C3, and that the addition of Solution D3 was completed when 16% of the total amount of Solution C3 was added.

When observing the resulting emulsion through an electron microscope, it was proved to comprise monodisperse, tetrahedral, twinned crystal and core/shell type silver halide grains having an average grain-size of 0.98 μm, a distribution width of 14%, an average iodide content of 1 mol % and a roundness (r/8).

(Preparation of regular crystal seed emulsion)

By making use of the following solutions, seed emulsion B was prepared.

| Solution A4 | |
|---|---|
| Ossein gelatin | 100 g |
| Potassium bromide | 2.05 g |
| Add water to make | 11.5 liters |

-continued

| Solution B4 | |
|---|---|
| Ossein gelatin | 55 g |
| Potassium bromide | 65 g |
| Potassium iodide | 1.8 g |
| 0.2 N sulfuric acid | 38.5 ml |
| Add water to make | 2.6 liters |
| **Solution C4** | |
| Ossein gelatin | 75 g |
| Potassium bromide | 950 g |
| Potassium iodide | 27 g |
| Add water to make | 3.0 liters |
| **Solution D4** | |
| Silver nitrate | 95 g |
| Add water to make | 2.7 liters |
| **Solution E4** | |
| Silver nitrate | 1410 g |
| Add water to make | 3.2 liters |

Solutions B4 and D4 were each added to Solution A4 maintained at 60° C. in a reactor vessel by a controlled double-jet method by taking 30 minutes. Thereafter, Solutions C4 and E4 were each added thereto by a controlled double-jet method by taking 105 minutes, while resulting mixture was stirred at 500 rpm.

The solutions were added at such a flow rate that any new nucleus may not be produced, any of the so-called Ostwald ripening may not be produced and any grain-size distribution may not be spread over while the grains were being grown. In the courses of adding a silver ion solution and a halide ion solution, the pAg was controlled to be within the range of 8.3±0.05 by making use of a potassium bromide solution and pH, within the range of 2.0±0.1 by sulfuric acid, respectively.

After completing the addition thereof and then controlling the pH as mentioned above, a desalting treatment was carried out in the procedures mentioned in JP Examined Publication No. 35-16086/1960 so as to removed an excess salt.

When observing the resulting seed emulsion, it was proved to be a cubic-shaped, tetradecahedral, monodisperse type emulsion having an average grain-size of 0.27 μm, a distribution width of 17% and a slightly chipped angle.

Preparation of Em-10

By making use of seed emulsion B and the following seven kinds of solutions, a comparative emulsion Em-10 was prepared.

| Solution A5 | |
|---|---|
| Ossein gelatin | 42.7 g |
| $HO(CH_2CH_2O)_m$—$(CH(CH_3)CH_2O)_{17}$—$(CH_2CH_2O)_nH$ ($m + n \approx 5.7$, a molecular weight = 1700), (a 10% methanol solution) | 9 ml |
| An aqueous 28% ammonia solution | 370 ml |
| An aqueous 56% acetic acid solution | 530 ml |
| Seed emulsion A | Equivalent to 0.417 mols |
| Add water to make | 4200 ml |
| **Solution B5** | |
| Ossein gelatin | 23.3 g |
| Potassium bromide | 2357 g |

-continued

| | |
|---|---|
| Add water to make | 4660 ml |
| Solution C5 | |
| Silver nitrate | 3510 g |
| An aqueous 28% ammonia solution | 2880 ml |
| Add water to make | 5940 ml |
| Solution D5 | |
| A fine-grained silver iodide emulsion | Equivalent to 0.199 mols |
| Solution E5 | |
| An aqueous 3.5 N potassium bromide solution | |
| Solution F5 | |
| An aqueous 56% acetic acid solution | |

Solutions B5, C5 and D5 were each added to Solution A5, while being violently stirred at 75° C. by taking 115 minutes by a double-jet method.

In the above process, the adding rates of Solutions B5 and C5 were varied functionwise to time so as to meet the critical growth rate and, the solutions were each added at a suitable adding rate so as not to produce any small-sized grains other than the seed crystals being grown, nor to produce any polydispersion due to an Ostwald ripening. In the supply of Solution D5, that is, in the supply of a fine-grained silver iodide emulsion, the supply rate thereof was varied to the grain-sizes in terms that the adding rate thereof was set to be 0.3 relative to the adding rate (or the mol ratio) to Solution C5, and the addition of Solution D5 was completed when 3% of the total amount of Solution C5 was added.

An addition of 1800 ml of an aqueous 4.37N potassium bromide solution was made at a constant flow rate by taking 6 minutes from the point of time 103 minutes after starting the addition of Solution C5 (or, from 76% of the total amount of Solution C5 added.) In the above-mentioned course, the pAg was varied from 7.5 into 9.92.

By making use of Solutions E5 and F5, the pAg was kept at 7.5 until an aqueous 4.37N potassium bromide solution was added, and the pH was kept at 7 in all the courses from the beginning to the end.

After completing the addition, a precipitating.desalting treatment was carried out, for removing an excess salts, by making use of an aqueous solution of Demol (manufactured by Kao-Atlas Inc.) and an aqueous magnesium sulfate solution, and gelatin was added. A redispersion was then carried out, so that an emulsion having a pAg of 8.5 and a pH of 5.85 could be obtained at 40° C.

When observing the resulting emulsion through an electron microscope, it was proved to comprise monodisperse, tetrahedral and core/shell type silver halide grains having an average grain-size of 0.98 μm, a distribution width of 18%, an average iodide content of 1 mol % and a roundness (r/8).

Example 2

An optimum chemical ripening treatment was subjected to each of the silver halide emulsions (Em-1) through (Em-10) prepared in Example 1 by adding the suitable amounts of chloroauric acid, sodium thiosulfate and ammonium thiocyanate at 50° C. Thereafter, an stabilizing treatment was subjected to the resulting ripened mixture, when completing the ripening treatment, by adding a suitable amount of 4-hydroxy-6-methyl-1,3,3a,7-tetrazaindene.

Next, the following additives were added to the chemically sensitized emulsions so as to use them as the light-sensitive silver halide emulsion coating solutions, respectively.

The additives are as follows. The amounts thereof to be added will be indicated by an amount per mol of silver halide.

| | |
|---|---|
| 1,1-dimethylol-1-bromo-1-nitromethane | 70 mg |
| t-butyl-catechol | 400 mg |
| Polyvinyl pyrrolidone (having a molecular weight of 10,000) | 1.0 g |
| A styrene-maleic anhydride copolymer | 2.5 g |
| Nitrophenyl-triphanyl phosphonium chloride | 50 mg |
| 2-anilino-4,6-dimercaptotriazine | 40 mg |
| Ammonium 1,3-dihydroxybenzene-4-sulfonate | 2 g |
| $C_4H_9OCH_2CH(OH)CH_2N(CH_2COOH)_2$ | 1 g |
| 1-phenyl-5-mercaptotetrazole | 15 mg |
| 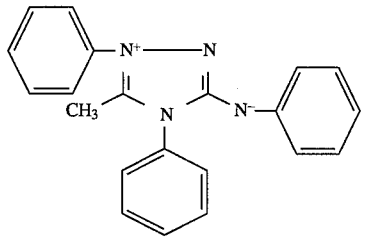 | 150 mg |
| 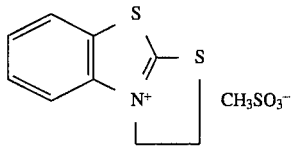 | 70 mg |

The additives applied to a protective layer solution were as follows. The amounts thereof added will be each indicated by an amount per liter of a coating solution used therein.

| | |
|---|---|
| Lime-treated inert gelatin | 68 g |
| Acid-treated gelatin | 2 g |
| Sodium-i-amyl-decyl sulfosuccinate | 1 g |
| Polymethyl methacrylate (a matting agent having an area average grain-size of 3.5 μm) | 1.1 g |
| Silicon dioxide (a matting agent having an area average grain-size of 1.2 μm) | 0.5 g |
| $(CH_2{=}CHSO_2CH_2)_2O$ (a layer hardener) | 250 mg |
| $C_4F_9SO_3K$ | 2 mg |
| An aqueous 40% glyoxal solution (a layer hardener) | 2.0 ml |
| 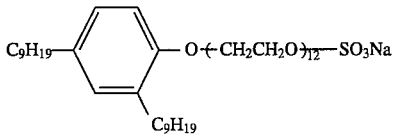 | 1.0 g |
| 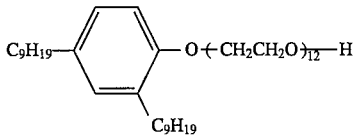 | 0.4 g |
| 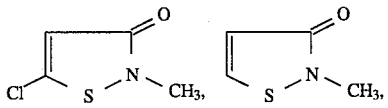 | 0.1 g |

-continued

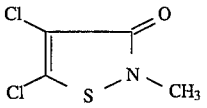

(50:46:4)

Samples 1 through 10 each shown in Table 1 were prepared in the following manner. The resulting emulsion coating solutions and a protective layer coating solution were simultaneously double-side coated on the both sides of a support made of a 175 μm-thick blue-tinted, subbed polyethylene terephthalate film base by making use of two units of slide-hopper type coaters at a coating speed of 80 m/min. so that a silver coated amount per one side of the support could be 2.5 g/m$^2$, a gelatin amount added to an emulsion could be 1.85 g/m$^2$ and a gelatin amount added to the protective layer could be 1.0 g/m$^2$, respectively.

One set of the resulting samples 1 through 10 was aged for two days at a temperature of 40° C. and a relative humidity of 80%. The aged set thereof and another set without aging preservation were subjected to the characteristic-comparison and the preservabilities thereof under the high humidity condition were evaluated.

Each of the resulting samples 1 through 10 was laminated with two sheets of intensifying screens (Model NR-160 manufactured by Konica Corp.), and they were exposed to X-rays through an aluminum wedge with a tube-voltage of 80 kvp, a tube-current of 50 mA and for 0.05 seconds.

Then, by making use of the following developer and fixer and a roller-transport type automatic processor (Model SRX-503 manufactured by Konica Corp.), each sample was developed for 25 seconds, and further was fixed, washed and dried up. It took 90 seconds for processing each sample from dry to dry. (The development was made at 32° C.; the fixing, at 33° C.; the washing, at 20° C. and the drying, at 50° C.; respectively.)

Next, the compositions of the developer and fixer each applied to the invention will be given below.

| Developer | |
|---|---|
| Part-A (for a finished amount of 12 liters) | |
| Potassium hydroxide | 450 g |
| Potassium sulfite (in an aqueous 50% solution) | 2280 g |
| Diethylene tetramine pentacetic acid | 120 g |
| Sodium hydrogen bicarbonate | 132 g |
| 5-methyl benzotriazole | 1.2 g |
| 1-phenyl-5-mercaptotetrazole | 0.2 g |
| Hydroquinone | 340 g |
| Add water to make | 5000 ml |

-continued

| | |
|---|---|
| Part-B (for a finished amount of 12 liters) | |
| Glacial acetic acid | 170 g |
| Triethylene glycol | 185 g |
| 1-phenyl-3-pyrazolidone | 22 g |
| 5-nitroindazole | 0.4 g |
| Starter | |
| Glacial acetic acid | 120 g |
| Potassium bromide | 225 g |
| Add water to make | 1.0 liter |
| Fixer | |
| Part-A (for making a finished amount of 18 liters) | |
| Ammonium thiosulfate (70 wt/vol %) | 6000 g |
| Sodium sulfite | 110 g |
| Sodium acetate.trihydrate | 450 g |
| Sodium citrate | 50 g |
| Gluconic acid | 70 g |
| 1-(N,N-dimethylamino)-ethyl-5-mercaptotetrazole | 18 g |
| Part-B (for making a finished amount of 18 liters) | |
| Aluminum sulfate | 800 g |

A developer was prepared by adding Part-A and Part-B at the same time to about 5 liters of water and, while keeping the resulting mixture stirred, water was added thereto so as to make 12 liters and the pH thereof was adjusted to be 10.40 by making use of glacial acetic acid. The resulting developer was used as a developer replenisher.

The starter was added in an amount of 20 ml/liter per liter of the resulting developer replenisher and the pH thereof was adjusted to be 10.26, so that the resulting solution could be used as a solution to be used.

A fixer was prepared by adding Part-A and Part-B at the same time to about 5 liters of water and, while keeping the resulting mixture stirred, water was added thereto so as to make 18 liters and the pH thereof was adjusted to be 10.40 by making use of sulfuric acid and NaOH. The resulting fixer was used as a fixer replenisher.

The sensitivities of each sample obtained in the development process were evaluated.

A sensitivity was indicated by a reciprocal of an exposure quantity capable of giving a density of fog +1.0. The sensitivity values were each indicated by a value relative to that obtained from Sample No. 1, that was regarded as a value of 100. The preservability under the high humidity conditions was indicated by a sensitivity variation (Δsensitivity (%)) to a sample subjected to an aging preservation, provided that each sensitivity of the samples without being subjected to any aging was regarded as a value of 100. The results thereof will be shown in Table 1, and characteristic values of the resulting emulsions will also be shown in Table 1.

TABLE 1

| Sample No. | Emulsion | Average iodide content (in mol %) | Degrees of roundness | Presence of twinned crystal plane | Average iodide content of grain surface layer (in mol %) | Sensitivity (without aging) | Δsensitivity (after aging) |
|---|---|---|---|---|---|---|---|
| 1 (comparison) | Em-1 | 1.0 | Less than r/15 | Nil | 3 | 100 | −19 |
| 2 (invention) | Em-2 | 1.0 | r/8 | Nil | 2 | 115 | ±0 |

TABLE 1-continued

| Sample No. | Emulsion | Average iodide content (in mol %) | Degrees of roundness | Presence of twinned crystal plane | Average iodide content of grain surface layer (in mol %) | Sensitivity (without aging) | Δsensitivity (after aging) |
|---|---|---|---|---|---|---|---|
| 3 (invention) | Em-3 | 1.0 | r/4 | Nil | 2 | 113 | ±0 |
| 4 (invention) | Em-4 | 2.5 | r/8 | Nil | 5 | 118 | −2 |
| 5 (comparison) | Em-5 | 3.5 | r/8 | Nil | 11 | 100 | −25 |
| 6 (comparison) | Em-6 | 2.5 | Less than r/15 | Nil | 8 | 95 | −26 |
| 7 (invention) | Em-7 | 2.5 | r/8 | Nil | 6 | 116 | −3 |
| 8 (invention) | Em-8 | 1.0 | r/8 | Nil | 2 | 106 | −2 |
| 9 (invention) | Em-9 | 1.0 | r/8 | Nil | 3 | 105 | −4 |
| 10 (comparison) | Em-10 | 2.5 | r/8 | Yes | 5 | 92 | −23 |

As shown in Table 1, it was proved that a sample of the invention was improved in desensitization that may be produced when preserving the sample under a high humidity condition, while keeping it with a high sensitivity.

Example 3

The resulting samples 1 through 10 were each laminated with two sheets of intensifying screens (NR-160 manufactured by Konica Corp.), and they were exposed to X-rays through an aluminum wedge with a tube voltage of 80 kvp, a tube current of 50 mA for 0.05 seconds.

Then, by making use of a roller-transport type automatic processor (Model SRX-503 manufactured by Konica Corp.), a 15 second-development was carried out with the same developer as used in Example 2, and a fixing, washing and drying treatments were carried out, respectively. The processing time was taken for 45 seconds from dry to dry. (provided, the temperatures of the developing, fixing, washing and drying treatments were 35° C., 33° C., 20° C. and 50° C., respectively.)

With each of the samples obtained by carrying out the development, the sensitivities and developability thereof were evaluated.

A sensitivity was indicated by a reciprocal of an exposure quantity capable of giving a density of fog +1.0. The sensitivity values were each indicated by a value relative to that obtained from Sample No. 1, that was regarded as a value of 100. The development progressiveness was indicated by a sensitivity variation (Δsensitivity (%)) to a sample obtained in the above-mentioned process, provided that each sensitivity of the samples obtained in Example 2 was regarded as a value of 100. The results thereof will be shown in Table 2.

TABLE 2

| Sample No. | Sensitivity | Δsensitivity (Developability) (in %) |
|---|---|---|
| 1 (comparison) | 100 | −15 |
| 2 (invention) | 125 | −5 |
| 3 (invention) | 125 | −3 |
| 4 (invention) | 120 | −8 |
| 5 (comparison) | 90 | −25 |
| 6 (comparison) | 85 | −25 |
| 7 (invention) | 126 | −5 |
| 8 (invention) | 118 | −3 |
| 9 (invention) | 115 | −5 |
| 10 (comparison) | 88 | −19 |

As shown in Table 2, it was proved that a sample of the invention was provided with a high sensitivity and a sufficient sensitivity was obtained even in a short processing time, and the developability thereof was superior as compared to comparative samples.

Example 4

Into (Em-1), (Em-2), (Em-4), (Em-5) and (Em-10) each prepared in Example 1, 30 mol % of sodium thiosulfate used in Example 2 was replaced at 50° C. by a selenium compound of N,N-dimethyl selenourea or by triphenyl phosphine selenide and, further, an equivalent amount of chloroauric acid used in Example 2 and 70 mol % of sodium thiocyanate of Example 2 thereof were each-added, so that an optimum chemical sensitization was carried out. Thereafter, a suitable amount of 4-hydroxy-6-methyl-1,3,3a,7-tetrazaindene was added when completing the ripening treatment so as to be stabilized.

The, in the same manner as in Example 2, Samples 11 through 17 were prepared as shown in Table 3. With the resulting Samples 11 through 17, the preservabilities thereof were also evaluated in the same manner as in Example 1 sensitivities and the fog densities of the samples were evaluated.

A sensitivity was indicated by a reciprocal of an exposure quantity capable of giving a density of fog +1.0. The sensitivity values were each indicated by a value relative to that obtained from Sample No. 1 of Example 2, that was regarded as a value of 100.

The preservability under the high humidity conditions was indicated by a fog difference (i.e., Δfog value) between a fog produced in a aged sample and a non-aged sample. It indicates that the more the difference is, the more a fog is increased under the high humidity conditions. The result thereof will be shown in Table 3.

TABLE 3

| Sample No. | Emulsion | Selenium compound | Sensitivity (without aging) | Δfog (After aging) |
|---|---|---|---|---|
| 11 (comparison) | Em-1 | N,N-dimethyl selenourea | 110 | 0.06 |
| 12 (invention) | Em-2 | N,N-dimethyl selenourea | 145 | 0.02 |
| 13 (invention) | Em-2 | Triphenyl phosphine selenide | 155 | 0.02 |
| 14 (invention) | Em-4 | Triphenyl phosphine selenide | 162 | 0.02 |
| 15 (invention) | Em-4 | N,N-dimethyl selenourea | 148 | 0.02 |
| 16 (comparison) | Em-5 | N,N-dimethyl selenourea | 112 | 0.06 |
| 17 | Em-10 | N,N-dimethyl | 103 | 0.08 |

TABLE 3-continued

| Sample No. | Emul-sion | Selenium compound | Sensitivity (without aging) | Δfog (After aging) |
|---|---|---|---|---|
| (comparison) | | selenourea | | |

As is obvious from the contents of Table 3, it was proved that the samples of the invention are each superior to the comparative samples, because the sensitivity thereof is high and a fog is scarcely increased even if they are preserved under the high humidity conditions.

What is claimed is:

1. A silver halide photographic emulsion, wherein said silver halide emulsion contains silver halide grains having an average iodide content of less than 3 mol %, said silver halide grains comprising monodispersed core/shell type silver halide grains having two twin planes parallel to each other and said core/shell type grains being substantially roundish hexahedral or tetradecahedral crystals.

2. The silver halide emulsion of claim 1, wherein said core/shell grains comprise an internal high iodide-containing region and an outermost surface layer, the internal region containing an iodide content higher than that of the outermost surface layer.

3. The silver halide emulsion of claim 2, wherein said surface layer contains 10 mol % or less iodide.

4. The silver halide emulsion of claim 1, wherein said silver halide grains account for 50% of total grains by number.

5. The silver halide emulsion of claim 1, wherein said silver halide emulsion is chemically-sensitized in the presence of a selenium compound or a tellurium compound.

* * * * *